United States Patent [19]

Cooper

[11] 4,232,847

[45] Nov. 11, 1980

[54] CONCRETE SCREED OR FORM SUPPORT

[76] Inventor: Carl W. Cooper, 368 Fifth Ave., San Diego, Calif. 92103

[21] Appl. No.: 814,227

[22] Filed: Jul. 11, 1977

[51] Int. Cl.[3] ..... F16M 13/00

[52] U.S. Cl. ..... 248/218.4; 248/249; 248/302; 403/397; 403/400

[58] Field of Search ..... 248/218.4, 238, 249, 248/296, 302, 303; 403/397, 400

[56] References Cited

U.S. PATENT DOCUMENTS

| | | | |
|---|---|---|---|
| 704,884 | 7/1902 | Lally | 248/218.4 X |
| 730,799 | 6/1903 | Lacy | 248/302 X |
| 1,016,822 | 2/1912 | Golden | 248/296 X |
| 1,728,613 | 9/1929 | Jones | 248/302 |

*Primary Examiner*—William H. Schultz

*Attorney, Agent, or Firm*—Knox & Knox

[57] ABSTRACT

A concrete screed or form support, for holding forms in position for the pouring of concrete. They are of prestressed metal and are readily attached to various shapes of the common concrete form stakes such as round, square or rectangular.

1 Claim, 3 Drawing Figures

CONCRETE SCREED OR FORM SUPPORT

BRIEF SUMMARY OF THE INVENTION

The present invention relates to a support for concrete forms. The support is made of tempered steel or other suitable metal.

The supports are readily and quickly wrapped around the stakes of any shape; round, square or rectangular. The particular function of the invention causes them to remain in position by reason of friction.

An object of the present invention is the provision of a concrete form support that is readily, quickly and easily attached to a driven stake without the usual laborious nailing, bolting or the like.

A further object of the invention is the provision of a concrete form support of low cost manufacuture.

Other objects and many of the attendant advantages of the present invention will be readily appreciated as the same becomes better understood by reference to the following detailed description when considered in connection with the accompanying drawings in which like reference numerals designate like parts throughout the Figures of the drawing and wherein.

DETAILED DESCRIPTION OF THE INVENTION

Figure 1:
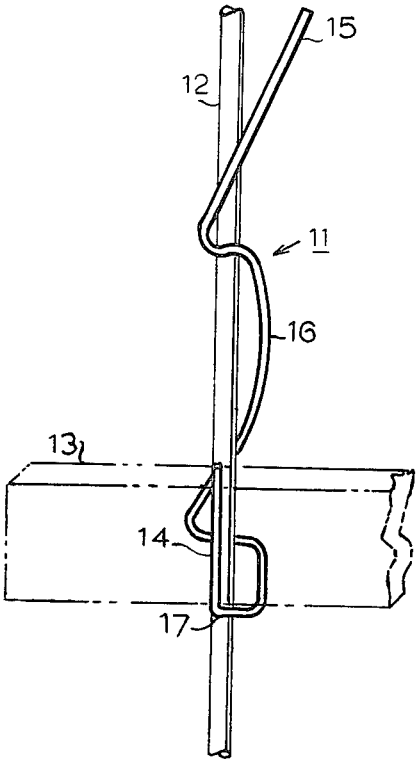
FIG. 1, is a front perspective view of a preferred embodiment of the present invention as attached to a stake, a form piece being shown in phantom seated in the L-shaped lower terminal portion in front of the stake.

Referring to FIG. 1, the support of this invention is indicated by the numeral 11, and is shown partially encircling the driven stake 12, the support 11, being a metal rod tempered and formed so as to be stressed inwardly to exert a three-point grip on the stake 12 in a frictional manner that secures the support, that is, said rod is shaped for partial encircling positioning on a stake and to exert a three-point grip upon such stake.

Figure 2:
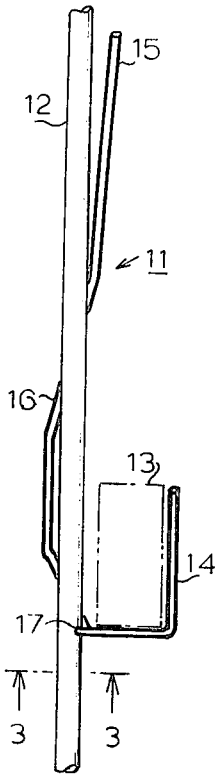
FIG. 2, is a side elevational view with the form piece indicated in phantom.

The concrete form piece 13, FIGS. 1 and 2, shown in phantom is held in place by an offset "L" shaped lower terminal potion 14 of the rod 11.

The upper terminal portion 15, FIGS. 1 and 2 acts as a handle cabable of being easily grasped by hand and pulled to obtain the leverage needed to force the rod in said partial encircling positioning on the stake 12.

Figure 3:
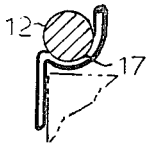
FIG. 3, is a cross sectional view of a portion of the support indicated as encompassing a round stake, taken at approxiamtely 3—3 of FIG. 2.

Referring to FIG. 3, the part 17, shown curved, is formed to grasp the round stake 12 in order to secure the lower portion of the support.

It is to be specifically understood, that the present invention 11 may be used with any shaped stake, round, square, hexigonal, octogonal or other as well as that illustrated in the accompanying drawing.

It is to be understood by those skilled in the particular art that the bent or formed parts are of sufficiently large dimensions to be adaptable to any shape of stake.

OPERATION

Referring back to FIGS. 1 and 2, it may be seen that if the "L" shaped extension 14 is placed in proper alignment and proper level in relation with the stake 12 and then the handle 15 is forced around the upper area of stake 12, thus the invention is secured in position.

Having thus described my invention, I claim:

1. A concrete screed or form support comprising: a formed and tempered rod of metal, for attachment to a stake; said rod having a generally upright three-point clamp portion shaped for partial encircling positioning on a stake with portions disposed about the axis of the clamp portion to exert a non-slip grip upon such stake; said rod having an off-set lower terminal L-shaped portion capable of basal as well as lateral support of a board or the like, and having an integral handgrip lever portion extending upwardly a considerable distance and outwardly at an angle to said axis, said lever being capable of being grasped for greatly amplifying leverage in forcing said clamp portion into and out of engagement with said stake.

* * * * *